United States Patent [19]

Braaten

[11] Patent Number: 4,629,065

[45] Date of Patent: Dec. 16, 1986

[54] BASEBALL EQUIPMENT HOLDER

[76] Inventor: Donald L. Braaten, Box 384, Colfax, Wis. 54730

[21] Appl. No.: 814,081

[22] Filed: Dec. 23, 1985

Related U.S. Application Data

[63] Continuation of Ser. No. 492,082, May 12, 1983, abandoned.

[51] Int. Cl.[4] ..... A63D 55/00

[52] U.S. Cl. ..... 206/315.1; 206/315.9; 206/579

[58] Field of Search ..... 206/315.1, 315.9, 579

[56] References Cited

U.S. PATENT DOCUMENTS

| | | | |
|---|---|---|---|
| 562,007 | 6/1896 | Martin | 211/45 |
| 988,468 | 4/1911 | Harth . | |
| 1,192,965 | 8/1916 | White | 211/87 |
| 2,138,418 | 11/1938 | Farhorne | 211/14 |
| 2,284,979 | 6/1942 | Lozarus | 211/113 |
| 2,680,513 | 6/1954 | Murphy et al. | 211/14 X |
| 2,969,881 | 1/1961 | Lilly . | |
| 3,128,021 | 4/1964 | Habbena | 211/14 X |
| 3,162,413 | 12/1964 | Hexdall . | |
| 3,349,922 | 10/1967 | Morrison . | |
| 3,521,758 | 7/1970 | Guilfoyle, Sr. . | |
| 3,650,407 | 3/1972 | Benham, Jr. . | |
| 3,687,499 | 8/1972 | Guilfoyle, Sr. . | |
| 3,698,563 | 10/1972 | Gordon et al. . | |
| 3,819,038 | 6/1974 | Candor et al. . | |
| 3,830,362 | 8/1974 | Tassone et al. . | |
| 3,869,137 | 3/1975 | Byrom . | |
| 3,954,182 | 5/1976 | McEvers . | |
| 3,954,239 | 5/1976 | Kerbs, Jr. . | |
| 3,981,404 | 9/1976 | Goeke . | |
| 4,111,309 | 9/1978 | Henry . | |
| 4,193,495 | 3/1980 | Keeley . | |
| 4,227,710 | 10/1980 | Laub . | |

FOREIGN PATENT DOCUMENTS

| | | | |
|---|---|---|---|
| 168034 | 3/1934 | Switzerland | 248/58 |
| 566616 | 9/1975 | Switzerland | 211/40 |

*Primary Examiner*—Robert W. Gibson, Jr.
*Assistant Examiner*—Sarah A. Lechok Eley
*Attorney, Agent, or Firm*—Burd, Bartz & Gutenkauf

[57] ABSTRACT

A baseball equipment holder comprising an elongate tubular housing that can have a diameter sufficient to accommodate a plurality of playing balls in side-by-side relationship. A plurality of longitudinally aligned openings open to the housing to retain a plurality of baseball bats. Hanger members extend from the housing for suspending items of baseball equipment. The housing is connectable to upright structure such as a chain link fence.

25 Claims, 16 Drawing Figures

FIG. 8
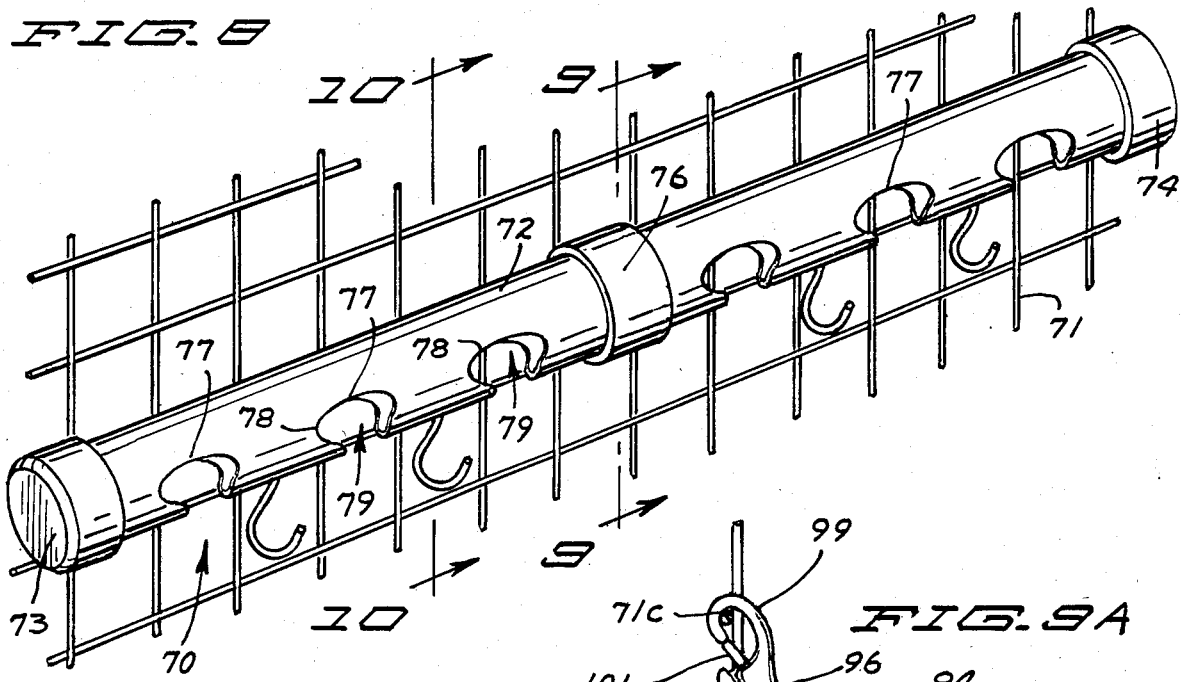
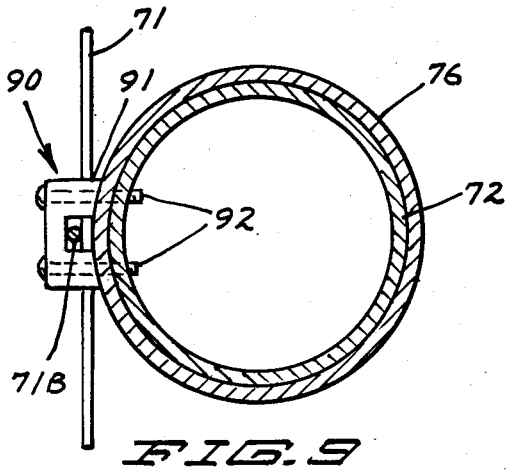
FIG. 9
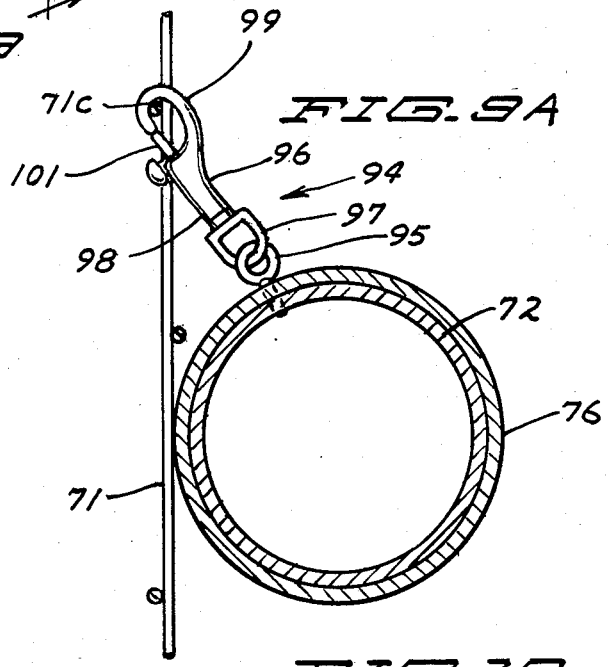
FIG. 9A
FIG. 10
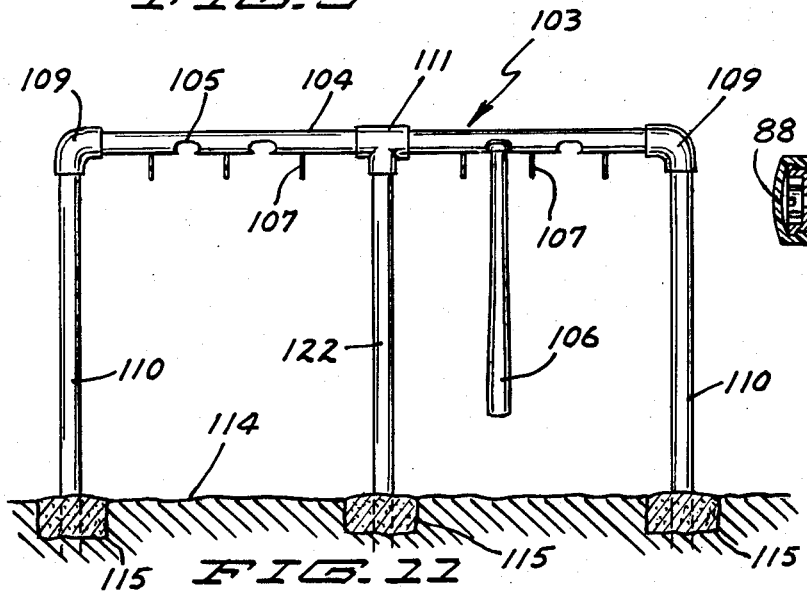
FIG. 22
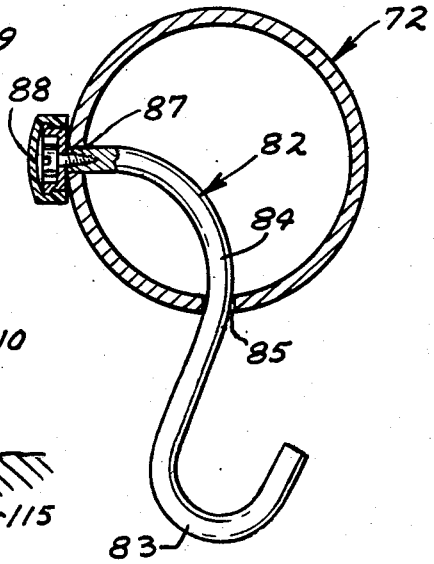

BASEBALL EQUIPMENT HOLDER

This is a continuation of application Ser. No. 492,082 filed May 12, 1983, now abandoned.

SUMMARY OF THE INVENTION

The invention pertains to a portable baseball equipment holder for temporary storage of baseball equipment during competitive games as well as practice sessions. Balls, bats and gloves are fundamental items of baseball equipment and large numbers of each are carried about by teams or individual members from game to game as well as to practice sessions. At the playing site, this equipment, when not in use, is oftentimes strewn loose along the sidelines in the vicinity of the playing field. Such disorganization is undesirable for a variety of reasons including misplacing of equipment and potential damage to equipment.

The present invention contemplates a holder to temporarily store items of baseball equipment at the playing or practice site. The holder includes an elongate tubular housing of a sufficient size to accommodate a plurality of bats in side-by-side relationship. In one form of the invention, the housing has an open end for insertion and removal of balls. Means can be provided for releasably attaching the housing to an upright structure, such as a chain link fence of the type typically found at a playing field. Other means can be provided for relatively permanent installation of the housing. A plurality of longitudinally aligned side openings are provided in the sidewalls of the housing. In one form of the invention, a first member extends from the sidewall into each opening for hanging a piece of baseball equipment, such as a baseball glove. Other means can be provided for suspending equipment, such as a baseball glove. A bottom opening extends from the side opening and is of a size to accommodate the portion of a bat shank near the knob end but small enough such that the knob cannot pass through, whereby a bat can be temporarily hung from the housing. The housing can be short enough to be stored in the usual equipment bag holding balls, gloves and bats for transport from place to place. The housing can be comprised of telescoping sections so as to be made even smaller for transport. The housing also can be comprised of a plurality of housing sections releasably joined together by threaded portions.

IN THE DRAWINGS

FIG. 1 is a perspective view of a baseball equipment holder of the invention installed on a fence and storing certain baseball equipment items;

FIG. 8 is a perspective view of a baseball equipment holder according to a fifth form of the invention installed on a fence;

FIG. 9 is an enlarged sectional view of a portion of the baseball holder of FIG. 8 taken along the line 9—9 thereof;

FIG. 9A is an enlarged sectional view of a modification of the suspension means of the baseball equipment holder of FIG. 9;

FIG. 10 is an enlarged sectional view of a portion of the baseball equipment holder of FIG. 3 taken along the line 10—10 thereof;

FIG. 11 is a front elevational view of a baseball equipment holder according to a sixth form of the invention;

DESCRIPTION OF PREFERRED EMBODIMENTS

Figures 2, 3, 4:
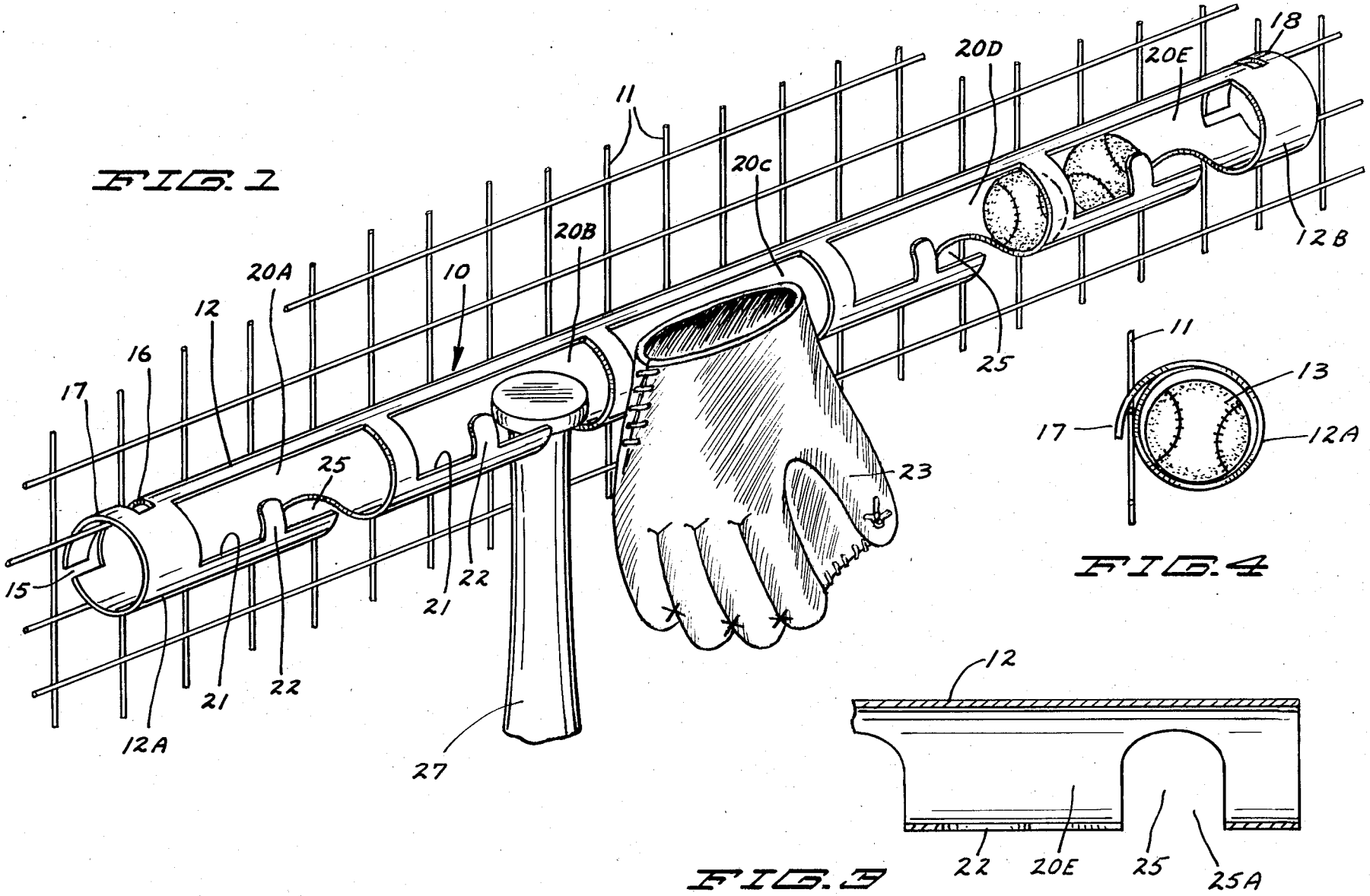
FIG. 2 is a front elevational view of the baseball equipment holder of FIG. 1 shown in use to hold equipment.
FIG. 3 is an enlarged sectional view of a portion of a baseball equipment holder of FIG. 2 taken along the line 3—3 thereof.
FIG. 4 is an enlarged end view of the baseball equipment holder of FIG. 2 taken along the line 4—4 thereof.
Figure 2:
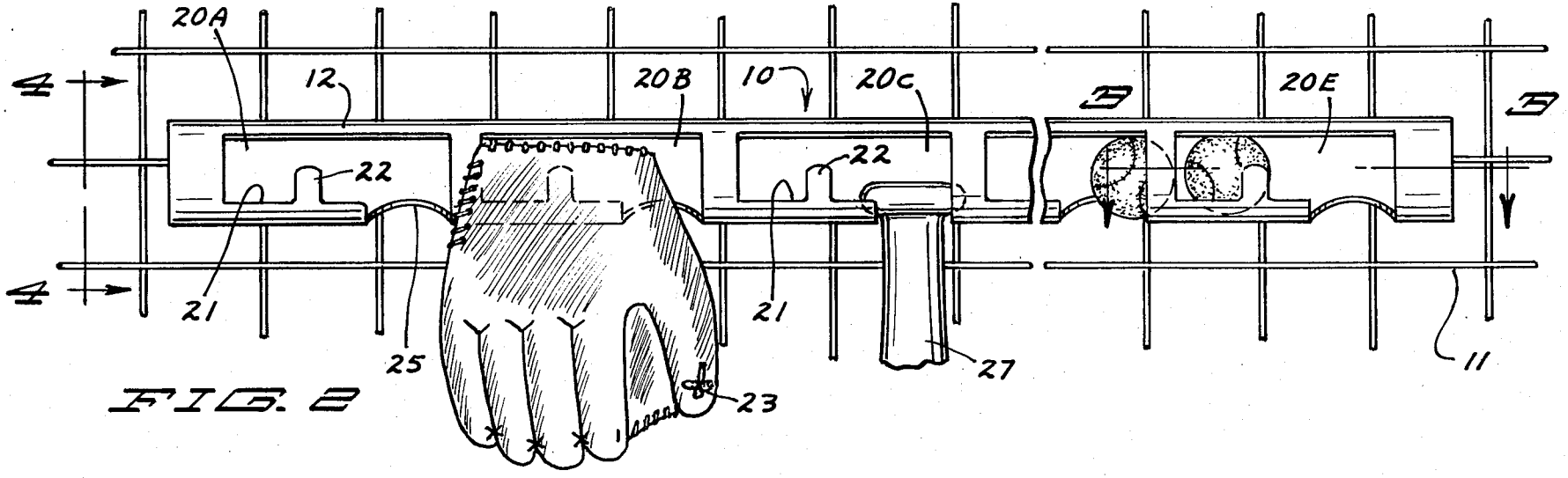

Referring to the drawings, there is shown in FIGS. 1–4 a baseball equipment holder indicated generally at 10 installed on a chain link fence 11 of the kind commonly found at various locations adjacent a baseball playing field proximate the home plate area or dugout areas. Equipment holder 10 holds and temporarily stores a variety of baseball equipment (including softball equipment) such as gloves, balls and bats, in a neat and organized fashion ready for use by the sport participants.

Equipment holder 10 includes an elongate tubular housing 12 having a longitudinal axis and an inside dimension or diameter sufficient to accommodate a plurality of playing balls in side-by-side relationship. The longitudinal end of housing 12 can be open for insertion and withdrawal of the balls. As shown in FIG. 2, a plurality of playing balls 13 can be stored in housing 10 when disposed with it axis horizontally orientated. Housing 10 can be formed of molded plastic or other suitable material.

Means are provided for releasably fixing housing 12 to chain link fence 11 at a location convenient for the sport participants. As shown in FIG. 1, an end 12A of housing 12 has a longitudinal slot or notch 15 extending inward intersecting a circumferential slot or notch 16 to form a resilient flap 17. The opposite end 12B of housing 12 has a similarly formed flap 18. Flaps 17 and 18 are resiliently connected to housing 12 and are insertable over links of chain link fence 11 to releasably secure housing 12 with respect to chain link fence 11.

Housing 12 has a plurality of longitudinally aligned openings 20A through E, which are open on the side of housing 12 opposite chain link fence 11 when installed thereon and face somewhat upwardly. The openings 20A through E are substantially identical and are partially defined by a lower edge 21. An upstanding member 22 extends from lower edge 21 approximately midway into the opening 20. Upstanding member 22 serves as a hanger member, whereby a piece of equipment, such as a baseball glove 23 as shown in FIG. 2 can be suspended for purposes of temporary storage.

A second or bottom opening 25 is formed in the bottom sidewall portion of housing 12 in conjunction with each side opening 20 (see FIG. 3). Second openings 25 face downwardly and have a throat 25A intersecting the side opening 20. Second openings 25 are adapted for retaining a bat indicated at 27 inserted therein through the throat 25A. The transverse dimension of each second opening 25 is sufficient to accommodate the shank of a standard bat near the butt or knob end but restricted enough to intercept the knob of the bat 27 at the butt end or handle thereof as shown in FIG. 2. Bats are easily inserted and withdrawn from the second openings 25.

Housing 12 can be approximately the length of a standard bat, whereby the equipment holder 10 is transported to and from playing areas along with the bats. Alternatively, it can be carried in an equipment bag, such as a duffle bag as is commonly used to hold a plurality of balls and other baseball equipment.

In use, the baseball equipment holder 10 is releasably secured to a chain link fence 11 or other suitable supporting surface by insertion of the flaps 17, 18 over link portions of the fence. A plurality of balls are stored inside of housing 12 by insertion through one of the open ends. Gloves are stored on the hanger members 22 as shown in FIG. 2. Other equipment could be hung from hanger members 22. Bats 27 are stored by insertion of the handle portion into the second openings 25 as shown in FIG. 2. The equipment is stored in orderly fashion and ready for use during the play or practice session. Holder 10 is also useable for display of baseball equipment as in a sporting goods store. In addition, housing 12 could carry indicia of the team name and the various compartments could be identified as to player identity or position.

Figure 5:
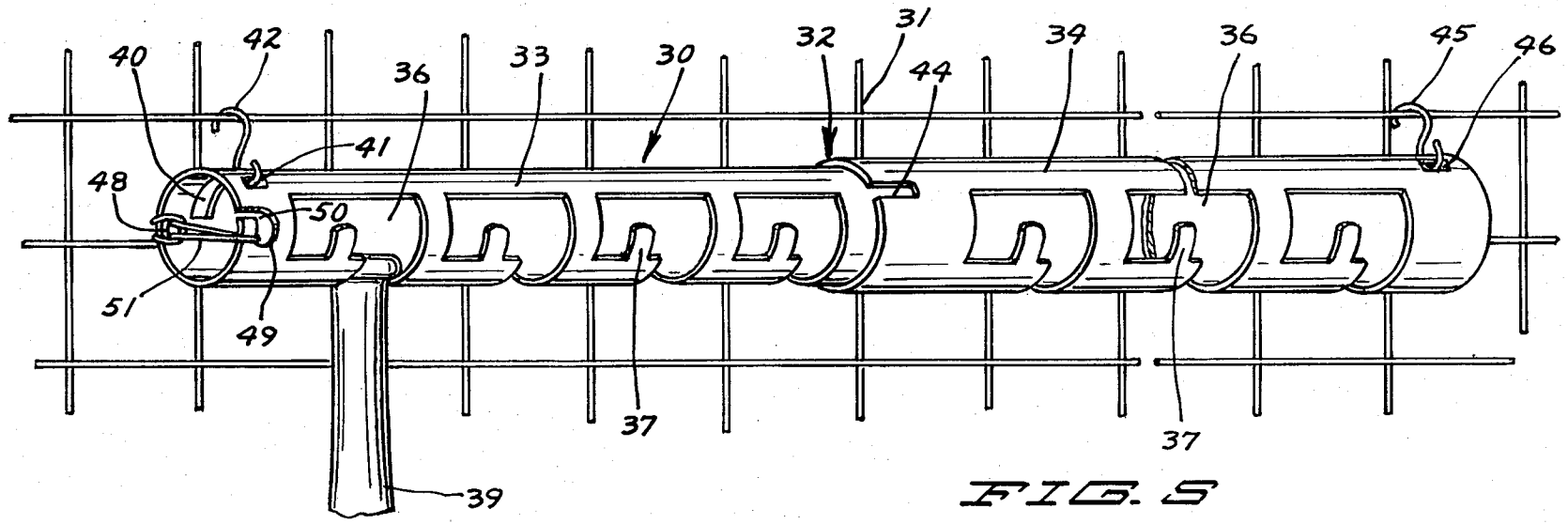
FIG. 5 is a perspective view of a baseball equipment holder according to a second form of the invention installed on a chain link fence.

A second form of baseball equipment holder according to the invention is shown in FIG. 5 and indicated generally at 30 removably installed on a chain link fence 31. Equipment holder 30 includes a generally tubular housing 32 comprised of a first tubular member 33 telescopically engaged in a second tubular member 34. First tubular member 33 has the smaller diameter of the two and has a diameter sufficient to accommodate a plurality of balls in side-by-side relationship. First and second tubular members 33, 34 are movable to an extended position as shown in FIG. 5 for use in temporary storage of baseball equipment items, and are collapsible by insertion of first tubular member 33 into the second tubular member 34 for storage and transport. In the collapsed configuration, equipment holder 32 is much smaller and can be easily transported in a baseball bag or other equipment bag.

First and second tubular members 33, 34 are both provided with longitudinally aligned side access openings 36 and hanger members 37 as previously described for the baseball equipment holder 10 shown in FIG. 1. A bottom opening is provided for accommodation of a bat 39 as previously described.

The outward end of first tubular member 33 is provided with a circumferential slot 40 and a short longitudinal slot 41 spaced from slot 40. Means provided to releasably attach the holder 30 to the fence 31 includes an S-hook 42. The lower loop of the S-hook 42 extends through the circumferential slot 40 and outwardly through the longitudinal slot 41. The upper loop of S-hook 42 is trained over a link of fence 31. When not in use, S-hook 42 can be rotated so that the upper loop thereof passes through the circumferential slot 40 and is accommodated in the interior of first tubular member 33. In such position, part of lower loop of S-hook 42 will extend outwardly of first tubular member 33. This portion is accommodated in a notch 44 on the inward end of second tubular member 34 when the first and second tubular members 33, 34 are in the collapsed configuration. The outward end of the second tubular member 34 is equipped with a second S-hook 45 having a lower loop accommodated in a longitudinal slot 46 and a circumferential slot (not shown) in identical fashion to the first S-hook 42.

The outer end of first tubular member 33 is also equipped with diametrically opposed holes 48, 49 with a slit 50 extended from the outer edge of first tubular member 33 in the hole 49. An endless loop elastic binder 51 is looped through the first hold 48 and back through one of its own end loops. A portion of the free end of elastic binder 51 is passed through slit 50 to be seated in hole 49 as shown in FIG. 5. Elastic binder 51 provides releasable closure means for the end of first tubular member 33 to prevent balls contained therein from accidentally rolling out.

Figures 6, 7:
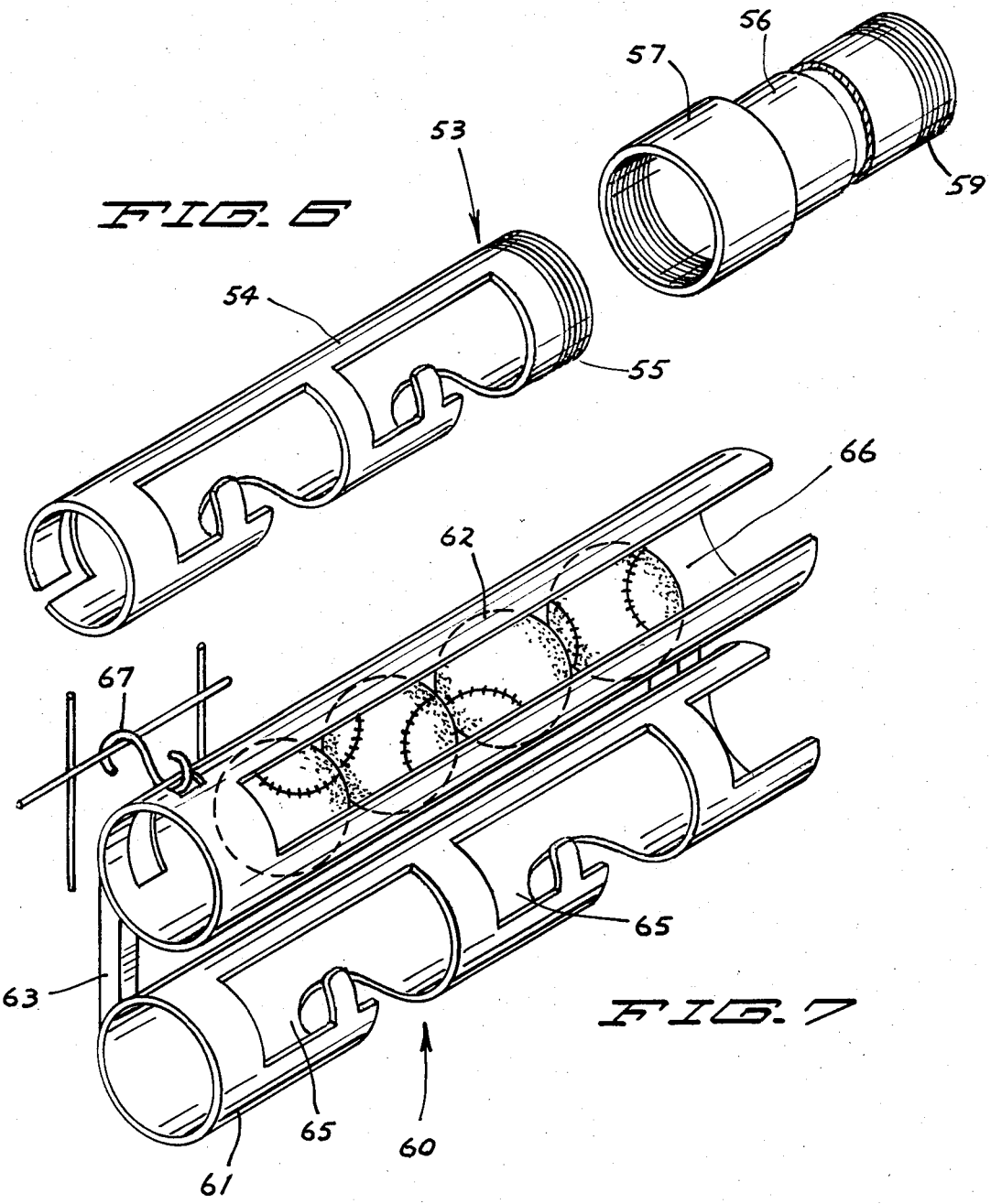
FIG. 6 is a perspective view partially in fragmentation of a baseball equipment holder according to a third form of the invention.
FIG. 7 is a perspective view of a portion of a baseball equipment holder according to a fourth form of the invention.

A third form of a baseball equipment holder is partially shown in FIG. 6 and indicated generally at 53. Equipment holder 53 has a first tubular member 54 having an outward end as previously described and an inward externally threaded end 55. A second tubular member 56 has an inward end with an internally threaded collar 57 for threaded engagement with the inward end 55 of the first tubular member 54. The outward end of second tubular member 56 can be as previously described or, alternatively, second tubular member 56 can be an intermediate member and can have a second externally threaded end 59 for engagement with another tubular member (not shown) having a collar like the collar 57. The equipment holder 53 can thus be disassembled for compact storage and transport. Through the use of various intermediate members, the length of the holder 53 can be varied as desired.

A fourth form of a baseball equipment holder is shown in FIG. 7 and indicated generally at 60. Equipment holder 60 includes a first tubular member 61 and a second parallel spaced apart tubular member 62. Tubular member 62 is disposed above the first tubular member 61 and connected thereto by a web 63. First tubular member 61 has a diameter sufficient to retain a plurality of balls in side-by-side relationship and has at least one open end for insertion and removal of balls. Tubular member 61 has a plurality of side access openings 65 as previously described for retention of baseball gloves, bats and the like. Second tubular member 62 is provided for accommodation of extra balls. It has a diameter of sufficient dimension to accommodate a plurality of added balls in side-by-side relationship. Second tubular member 62 has an elongate longitudinal slot 66 for visual access to the interior thereof. An S-hook 67 is provided for suspending the equipment holder 60 from an upright structure, such as a chain link fence. At the opposite end of the equipment holder 60 (not shown), a second S-hook is provided for the same purpose.

A fifth form of a baseball equipment holder is shown in FIG. 8 indicated generally at 70 installed on a chain link fence 71. Equipment holder 70 includes an elongate, horizontally disposed housing 72 having end caps 73, 74 and an intermediate collar 76, whereby housing 72 can be formed of two sections joined at collar 76. Housing 72 has a plurality of bat mounting openings 77 for the retention of bats. Each opening 77 has a forwardly open portion 78 and a downwardly open portion 79. Forwardly open portion 78 has a transverse dimension greater than that of the knob on the end of a bat, and the downwardly open portion 79 has a transverse dimension less than that of the knob end of a bat but greater than the shank of the bat adjacent the knob. The knob of the bat is insertable through the forwardly open portion 78 and rests on the edges defining the downwardly open portion 79 thus to retain the bat downwardly suspended from the housing 72. Bats are readily insertable and removable from the openings 77.

A plurality of hooks 82 depend from housing 72 and are spaced in intermediate relationship to openings 77. Hooks 82 are provided for temporary storage of various baseball equipment items, such as gloves, jackets, caps or batting helmets. As shown in FIG. 10, each hook 82 has an upwardly open loop portion 83 depending from housing 72, and a shank 84 extending from loop portion 83 through a bottom aperture 85 in housing 72. The shank 84 curves through the housing 72 and extends outwardly through a back aperture 87. A screw and cap assembly 88 includes a screw threaded into the end of shank 84 located in aperture 87 from the exterior of housing 72 to hold hook 82 securely in place.

As shown in FIG. 9, a clamp assembly 90 to mount housing 72 to fence 71 includes a C-shaped clamp block 91 in straddling relationship to a horizontal segment of fence 71B with outer ends in surface contact with collar 76. A pair of screws 92 pass through suitable openings provided in the legs of clamp block 91 and are threaded through collar 76 and housing 72 to securely hold housing 72 with respect to fence 71. A plurality of clamp assemblies 90 can be provided. U-bolt assemblies could be provided in place of the clamp block 91.

FIG. 9A shows an alternative means for releasably securing housing 72 to fence 71. A clip or swivel snap hook assembly 94 includes an eye-screw 95 threaded into the collar 76 and housing 72. A swivel snap hook 96 has an end loop 97 in engagement with the eye of eye-screw 95. A swivel block 98 is rotatably connected to the eye loop 97. A hook 99 extends from the swivel block 98 and is in engagement with a horizontal fence segment 71C. The hook 99 has a spring-loaded catch 101 biased in spanning relationship to the hook throat and manually movable to a position of clearing relationship with respect to the throat for engagement and disengagement of the hook portion 99 with a segment of the fence 71. A plurality of clip assemblies 94 can be provided for releasably assembling the housing 72 to a fence.

A sixth form of a baseball equipment holder is shown in FIG. 11 indicated generally at 103 and is installed in relatively permanent fashion proximate a baseball playing area. Equipment holder 103 includes a tubular, elongate housing 104 having a generally horizontally disposed axis and a plurality of bat-retaining openings 105 for retaining bats 106 in a generally vertical position elevated sufficiently to be out of contact with the ground. A plurality of hooks 107 are spaced intermediately between the openings 105 for suspending baseball gloves, hats and the like. End elbows 109 are located on the ends of housing 104 and have downwardly directed openings which accommodate the upper ends of support posts 110. Housing 104 can have an intermediate T-shaped collar 111 permitting the housing to be formed of two sections. Collar 111 has a downwardly directed socket which accommodates the upward end of an intermediate support post 112. The lower ends of the support posts 110, 112 are anchored in the ground 114 as by being imbedded in cement footings 115. The lower ends could alternatively simply be anchored in holes provided in the ground or anchored in stands located above the ground. Equipment holder 103 is relatively permanently installed at a baseball playing site for temporary storage of equipment.

Figure 12:
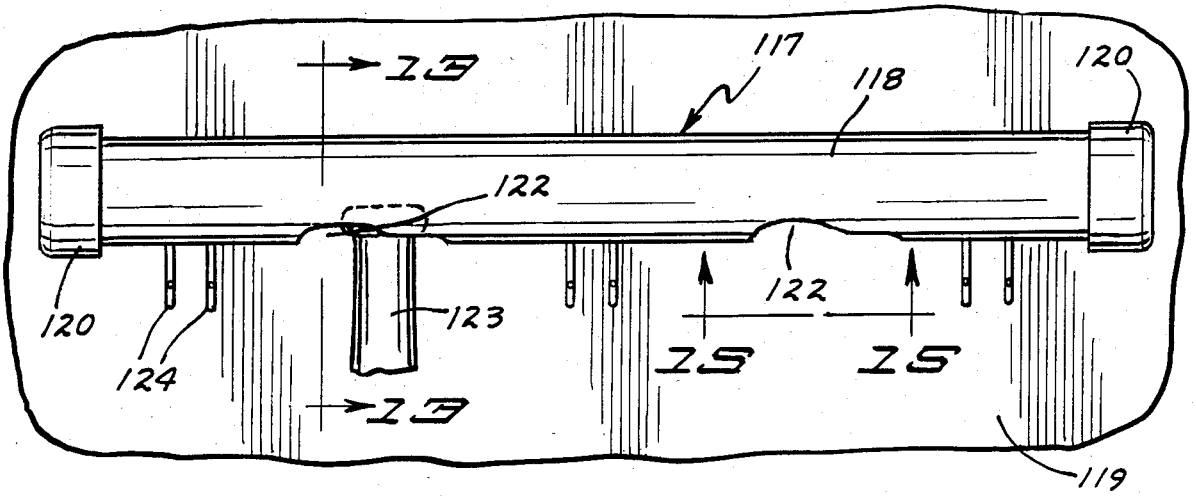
FIG. 12 is a front elevational view of a baseball equipment holder according to a seventh form of the invention installed on a wall.
Figure 13:
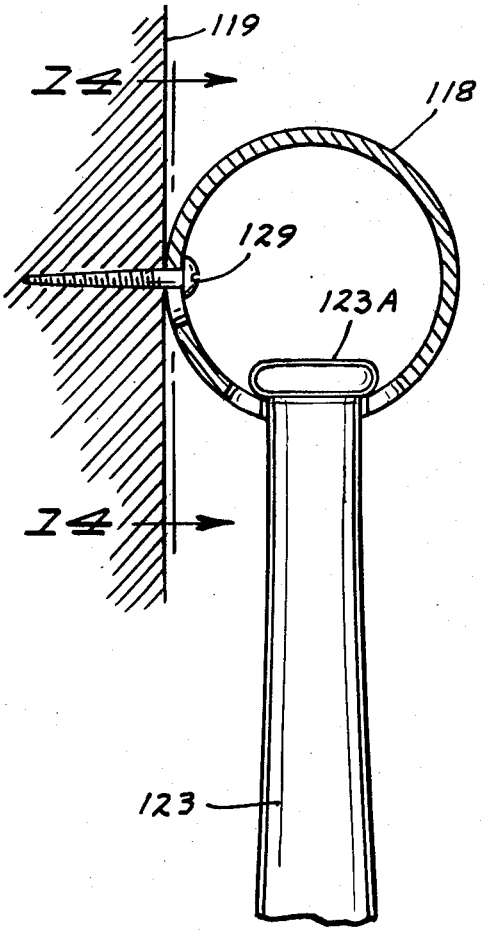
FIG. 13 is an enlarged sectional view of a portion of the baseball equipment holder of FIG. 12 taken along the line 13—13 thereof.
Figure 14:
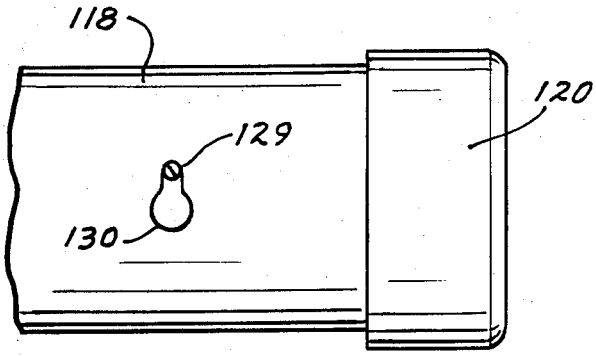
FIG. 14 is a side elevational view of an end portion of the baseball equipment holder of FIG. 13 taken along the line 14—14 thereof.
Figure 15:
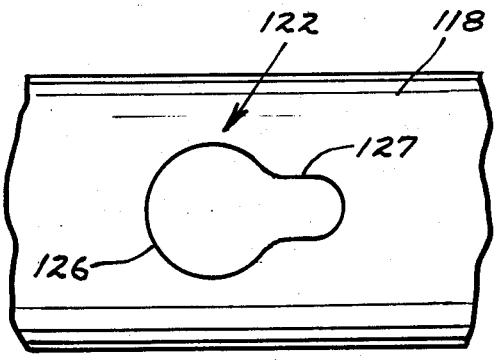
FIG. 15 is an enlarged bottom view of a portion of the baseball equipment holder of FIG. 12 taken along the line 15—15 thereof.

Referring to FIGS. 12–14, there is shown a baseball equipment holder according to a seventh form of the invention indicated generally at 117 for installation on a wall as at the house of a ball player, a school storage room, a store or the like. Equipment holder 117 includes an elongate, tubular housing 118 installed on a vertical wall 119 and having end caps 120. Housing 118 has a plurality of spaced apart downwardly open bat-retaining openings 122. Two bat openings 122 are shown although more could be provided as described with respect to earlier embodiments of the invention. Housing 118 is elevated a sufficient distance above the ground such that bats 123 can be suspended from the openings 122 with lower ends spaced above the ground. A plurality of depending hooks 124 are intermediately spaced along the length of housing 118. The hooks 124 are disposed in pairs as shown to provide additional space for retention of such various baseball equipment as hats, gloves, batting helmets, jackets and the like.

As shown in FIG. 12, each bat opening 122 is downwardly open and includes a major circular portion 126 centrally spaced on the bottom of housing 118, and a minor, or smaller, neck portion 127 extended from the circular portion 126. The circular portion 126 is of sufficient diameter to permit passage of the knob end of a bat 123A (see FIG. 13). The minor portion 127 is of a width to permit passage of the shank portion of the bat adjacent the knob end but retain the knob end. A bat is inserted in the opening 122 by passage of the knob end of the bat through the major portion 126, and then movement of the shank into the minor portion 127 whereby the knob is restrained. The reverse procedure is effected in order to readily remove the bat. As shown in FIG. 13, the housing 118 is releasably mounted to the wall 119 by a plurality of round-head screws 129. The rear portion of housing 118 is provided with a plurality of horizontally spaced inverted keyhole-type openings 130 (FIG. 14) having an enlarged lower portion and a necked-in upper portion, a keyhole opening 130 corresponding to each screw 129. Each screw 129 is threaded into the wall 119 with a short shank portion extending outwardly of the wall and terminating in the round head. Housing 118 is installed on wall 119 by inserting the heads of screws 129 through the lower larger portions of keyhole openings 130. Housing 118 is then rotated until the shanks of the screws 129 are seated in the narrower upper portions of the keyhole openings 130 and are retained in that position by gravity. Removal of housing 118 from the wall 119 is easily effected by the reverse procedure.

While there has been shown and described certain preferred embodiments of a baseball equipment holder according to the invention, it will be apparent to those skilled in the art that certain deviations can be had therefrom without departing from the scope and spirit of the invention.

The embodiments of the invention in which an exclusive property or privilege is claimed are defined as follows:

1. A baseball equipment holder comprising:

an elongate tubular, generally cylindrical housing having an interior diameter sufficient to accommodate a plurality of playing balls in side-by-side relationship and having at least one open end for insertion and withdrawal of balls;

means to connect the housing to upright structure with a longitudinal axis in generally horizontal orientation;

a plurality of longitudinally aligned side openings on a side of the housing that are horizontally facing when the housing is connected to upright structure, each side opening being partially defined by a lower edge;

a hanger member constituted as a circumferential extension of the housing extending from the lower edge of each opening into the opening for hanging a piece of baseball equipment;

a bottom opening associated with each side opening, being downwardly facing and of a transverse dimension sufficient to accommodate the shank of a baseball bat near the knob end thereof but restrict passage of the knob end, intersecting the side opening at a location wider than the knob end of a bat whereby a baseball bat can be retained in depending relationship by the bottom opening and inserted and removed by the side opening.

2. The baseball equipment holder of claim 1 including: at least one baseball bat having a shank end located in one of the bottom openings, and the knob end located in the tubular housing, and at least one baseball located in the tubular housing.

3. The equipment holder of claim 1 wherein: said housing is comprised as first and second telescopically engageable members.

4. The equipment holder of claim 1 wherein: said housing is comprised as a plurality of threadably connected members.

5. The equipment holder of claim 1 wherein: said housing includes a first member having an externally threaded end, a second member having an interiorly threaded collar at one end releasably connectable to the exteriorly threaded end of the first member.

6. The equipment holder of claim 1 wherein: both ends of said housing are open, said means to connect the housing to upright structure including a first slot means at a first end of the housing forming a first flap engageable with a portion of the upright structure and a second slot means at the second end of the housing forming a second flap engageable with a portion of the upright structure.

7. The equipment holder of claim 6 wherein: said first slot means includes a first longitudinal slot extended inwardly from the first end of the housing, and a first circumferential slot extended from the inward end of the first longitudinal slot to form said first flap, said second slot means including a second longitudinal slot extended inwardly from the second end of the housing and a second circumferential slot extended from the inward end of the second longitudinal slot to form said second flap.

8. The equipment holder of claim 1 wherein: means to connect the housing to upright structure includes first and second S-hooks connected to the housing proximate the first and second ends thereof and having hook loops engageable with the upright structure.

9. The equipment holder of claim 8 including: a first circumferential slot proximate the first end of the housing, a first longitudinal slot aligned with and spaced from the first circumferential slot, said first S-hook having an upper loop engageable with upright structure and a lower loop extended through the first circumferential slot and the first longitudinal slot; and a second circumferential slot proximate the second end of the housing, a second longitudinal slot aligned with and spaced from the second circumferential slot, said second S-hook having an upper loop engageable with upright structure and a lower loop extended through the second circumferential slot and the second longitudinal slot.

10. The equipment holder of claim 9 including: releasable closure means at one end of the housing including a pair of diametrically opposed holes proximate the end of the housing, a slit extending from the housing end to a first of the holes, an endless loop elastic binder looped through the second of the holes and having a portion insertable through the slit to the first hole to be retained therein to close the end of the housing.

11. A baseball equipment holder comprising:

an elongate tubular housing having an interior diameter sufficient to accommodate a plurality of playing balls in side-by-side relationship and having at least one open end for insertion and withdrawal of balls;

a plurality of longitudinally aligned side openings on a side of the housing, each being partially defined by a lower edge;

a hanger member extending from the lower edge of each opening into the opening for hanging a piece of baseball equipment;

a bottom opening associated with each side opening, being downwardly open and intersecting the side opening and of a size sufficient to accommodate the shank of a baseball bat near the knob end thereof but restrict passage of the knob end whereby a baseball bat can be retained by the bottom opening;

means to connect the housing to upright structure including first and second S-hooks connected to the housing proximate the first and second ends thereof and having hook loops engageable with the upright structure;

releasable closure means at one end of the housing including a pair of diametrically opposed holes proximate the end of the housing, a slit extending from the housing end to a first of the holes, an endless loop elastic binder looped through the second of the holes and having a portion insertable through the slit to the first hole to be retained therein to close the end of the housing.

12. The baseball equipment holder of claim 1 including: a second elongate tubular housing spaced from and in parallel relationship to the first elongate tubular housing and having a diameter sufficient to accommodate a plurality of playing balls in side-by-side relationship, and means connecting the first and second tubular housings.

13. The equipment holder of claim 12 including: means on the second housing for connection to upright support structure, said first housing being situated beneath the second housing when connected to upright structure.

14. A baseball equipment holder comprising:

generally cylindrical tubular housing means having a diameter sufficient to accommodate a plurality of playing balls in side-by-side relationship, a plurality of playing balls located in side-by-side relationship in the tubular housing means, said tubular means having a plurality of horizontally facing side openings and downwardly facing bottom openings connected to the side openings for retention of a plurality of bats, a hanger member upwardly extended into each side opening to support baseball equipment thereon, a baseball bat having a handle end with a shank and a knob end wider than the shank, said side openings having a horizontal dimension wider than the knob end of the bat, said bottom opening having a width less than the knob end of the bat and greater than the shank whereby the bat end is insertable and removable through the side opening and is stored in depending relationship by the bottom opening, and means to releasably suspend the tubular housing means from upright structure.

15. An equipment holder of claim 14 wherein: said tubular housing means is comprised as a plurality of telescoping tubular members.

16. The equipment holder of claim 14 wherein: said tubular housing means is comprised as a plurality of threadably connectable members.

17. A baseball equipment holder comprising:

an elongate tubular cylindrical housing having a longitudinal axis;

means connecting the housing to generally upright structure with said housing axis in generally horizontal orientation;

at least one baseball bat of the type having a reduced shank portion and a knob end connected to and wider than the reduced shank portion;

said housing having a plurality of bat-mounting openings for retention of a plurality of baseball bats, each said opening having a first horizontally facing portion and a second downwardly facing portion connected in intersecting relationship to the first portion, said first portion having a horizontal transverse dimension greater than the knob width to permit passage of the knob end of the baseball bat into and out of the interior of the housing, said second portion having a transverse dimension sufficient to permit passage of the shank portion of a baseball bat adjacent the knob end and restrict passage of the knob end whereby a baseball bat can be suspended by the knob end from the opening; and a plurality of hook members connected to the housing in depending relationship for hanging items of baseball equipment.

18. The equipment holder of claim 17 wherein: said housing has an internal diameter sufficient to accommodate a plurality of playing balls in side-by-side relationship.

19. The equipment holder of claim 17 wherein: said hook members are comprised as a plurality of hooks connected to the housing and intermediately spaced between the openings.

20. The equipment holder of claim 17 wherein: said hook members are comprised as a plurality of pairs of hooks connected to the housing and intermediately spaced between the openings.

21. The equipment holder of claim 17 wherein said housing is connected to a fence and wherein: said fastening means include a plurality of clamp assemblies; each clamp assembly including a C-shaped clamp block adapted to straddle a segment of fence and having a pair of legs in surface contact with said housing, and a pair of screws, each screw passing through a leg of the clamp block and being threaded into the housing.

22. The equipment holder of claim 17 wherein said housing is connected to a fence and wherein: said means to connect the housing includes a plurality of swivel snap hook assemblies.

23. The baseball equipment holder of claim 17 wherein: said upright structure comprises a pair of upright support posts, said means connecting the housing to the generally upright structure comprising end elbows located at each end of the housing connected at one end to the housing and at the other end to a support post.

24. The equipment holder of claim 17 wherein said upright structure is comprised as a vertical wall and wherein: said means to connect the housing to the upright structure includes a plurality of spaced apart inverted keyhole-shaped openings in the housing, a plurality of screws mounted in the wall and relatively spaced for insertion through the keyhole openings in the housing.

25. The equipment holder of claim 24 wherein: said hook members are comprised as a plurality of hooks connected to the housing and intermediately spaced between the openings.

* * * * *